US008574135B2

(12) United States Patent
Chen

(10) Patent No.: US 8,574,135 B2
(45) Date of Patent: Nov. 5, 2013

(54) BALL-HITTING GLOVE ASSEMBLY FOR BOXING TRAINING

(76) Inventor: Yi-Yi Chen, Changhua Hsien (TW)

( * ) Notice: Subject to any disclaimer, the term of this patent is extended or adjusted under 35 U.S.C. 154(b) by 217 days.

(21) Appl. No.: 13/271,211

(22) Filed: Oct. 11, 2011

(65) Prior Publication Data

US 2012/0100966 A1 Apr. 26, 2012

(30) Foreign Application Priority Data

Oct. 20, 2010 (TW) ..... 99220277 U

(51) Int. Cl.
*A63B 21/00* (2006.01)

(52) U.S. Cl.
USPC ..... 482/83; 482/124; 473/438; 473/427; 473/508; 473/422

(58) Field of Classification Search
USPC ..... 482/121, 124, 83; 473/424, 438, 427, 473/508
See application file for complete search history.

(56) References Cited

U.S. PATENT DOCUMENTS

| | | | | |
|---|---|---|---|---|
| 2,142,088 | A * | 1/1939 | Anderson | 426/572 |
| 3,843,126 | A * | 10/1974 | Bandy | 473/576 |
| 7,976,414 | B2 * | 7/2011 | McKay | 473/458 |
| 2007/0155544 | A1 * | 7/2007 | Killion | 473/424 |

* cited by examiner

*Primary Examiner* — Jerome W Donnelly
(74) *Attorney, Agent, or Firm* — Hershkovitz & Associates, PLLC; Abe Hershkovitz

(57) ABSTRACT

A ball-hitting glove assembly for boxing training has a glove, a ball and a rope. The glove has a palm section, a hand back section and a finger section. The rope is mounted securely on the glove and has a glove end and a ball end. The glove end of the rope is mounted securely on the hand back section. The ball end is opposite to the glove end of the rope. The ball is mounted securely on the ball end of the rope. The ball-hitting glove assembly is easily carried and is convenient for boxing-training at any time when a user travels or exercises outside. This is greatly practical for those who like boxing.

14 Claims, 9 Drawing Sheets

BALL-HITTING GLOVE ASSEMBLY FOR BOXING TRAINING

BACKGROUND OF THE INVENTION

1. Field of the Invention

The present invention relates to a ball-hitting glove assembly for boxing training, and more particularly to a ball-hitting glove assembly for boxing training to be easily carried for a user to exercise at any time.

2. Description of Related Art

Conventional boxing training apparatuses comprise a boxing sandbag A as shown in FIG. 10, a first training ball B as shown in FIG. 11, a second training ball C as shown in FIG. 12 and a third training ball D as shown in FIG. 13.

The first training ball B has a main body and two ropes respectively mounted securely on a top end and a bottom end of the main body. The second training ball C has a main body and a spring connected with the main body of the second training ball C and a ceiling. The third training ball D has a main body, a mount and a spring connected with the main body of the third training ball D and the mount.

However, the conventional boxing training apparatuses are heavy or are mounted securely at a specific location. The boxing training apparatuses cannot be easily carried and are inconvenient for boxing-training at any time.

Because the boxing training apparatuses are expensive, users have to go to a boxing gym to rent the boxing training apparatuses. This is greatly inconvenient.

To overcome the shortcomings, the present invention tends to provide a ball-hitting glove assembly for boxing training to mitigate the aforementioned problems.

SUMMARY OF THE INVENTION

The main objective of the invention is to provide a ball-hitting glove assembly for boxing training that is easily carried for a user to exercise at any time.

A ball-hitting glove assembly for boxing training has a glove, a ball and a rope. The glove has a palm section, a hand back section and a finger section. The rope is mounted securely on the glove and has a glove end and a ball end. The glove end of the rope is mounted securely on the hand back section. The ball end is opposite to the glove end of the rope. The ball is mounted securely on the ball end of the rope. The ball-hitting glove assembly is easily carried and is convenient for boxing-training at any time when a user travels or exercises outside. This is greatly practical for those who like boxing.

Other objects, advantages and novel features of the invention will become more apparent from the following detailed description when taken in conjunction with the accompanying drawings.

DETAILED DESCRIPTION OF PREFERRED EMBODIMENT

Figure 1:
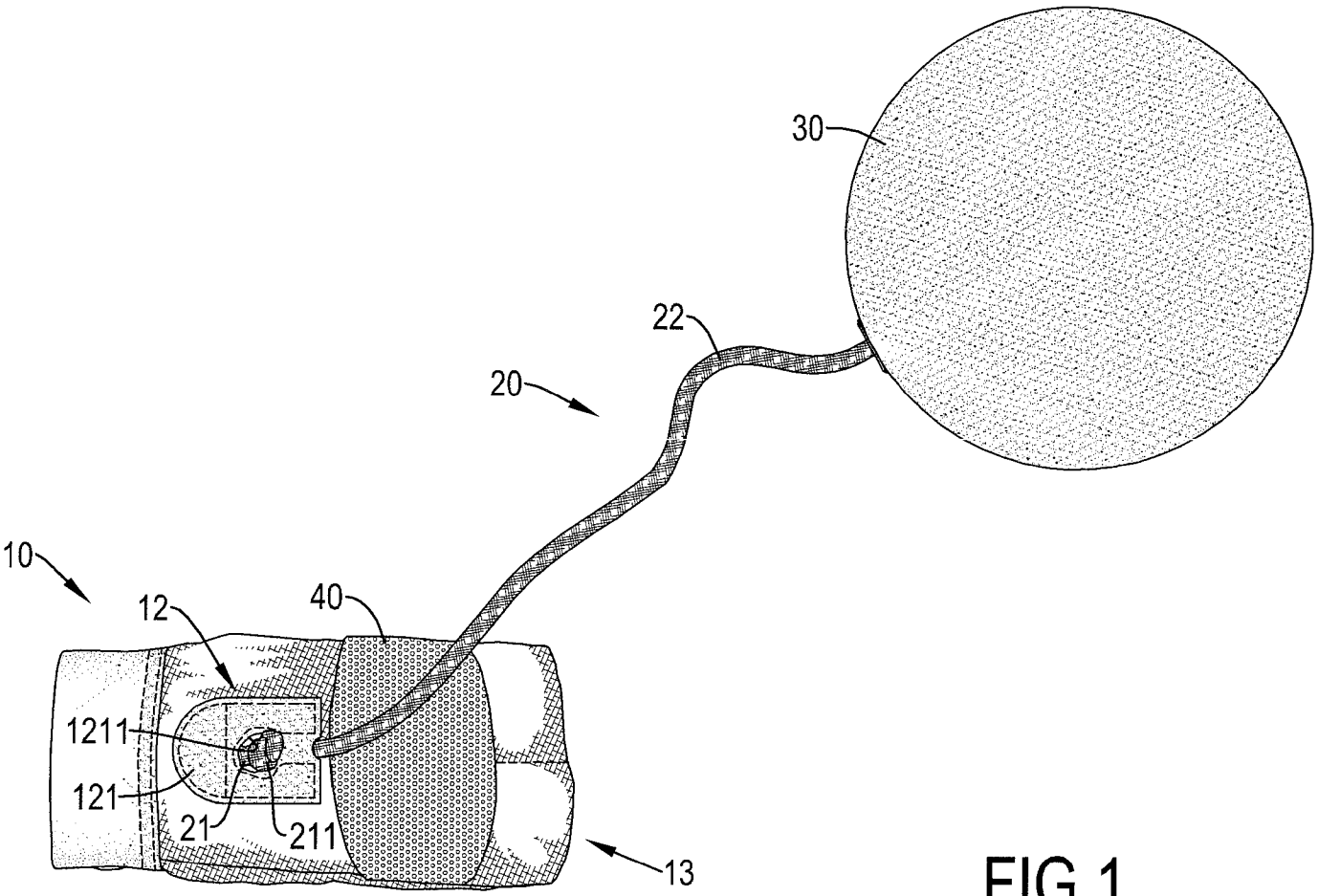
FIG. 1 is a top view of a first embodiment of a ball-hitting glove assembly for boxing training in accordance with the present invention.
Figure 2:
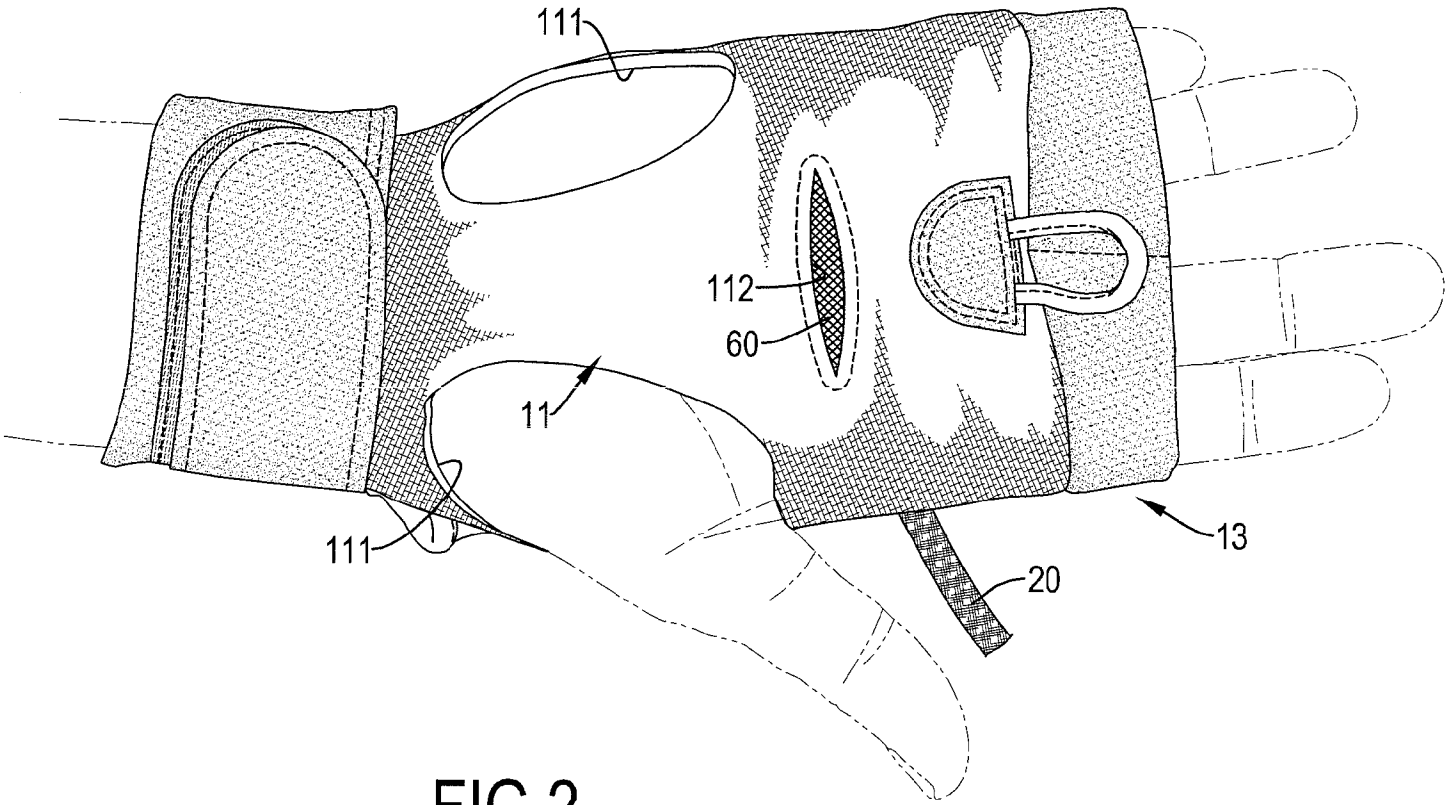
FIG. 2 is an enlarged operational bottom view of a glove of the ball-hitting glove assembly for boxing training in FIG. 1 showing that a user wears the glove on a right hand.
Figure 3:
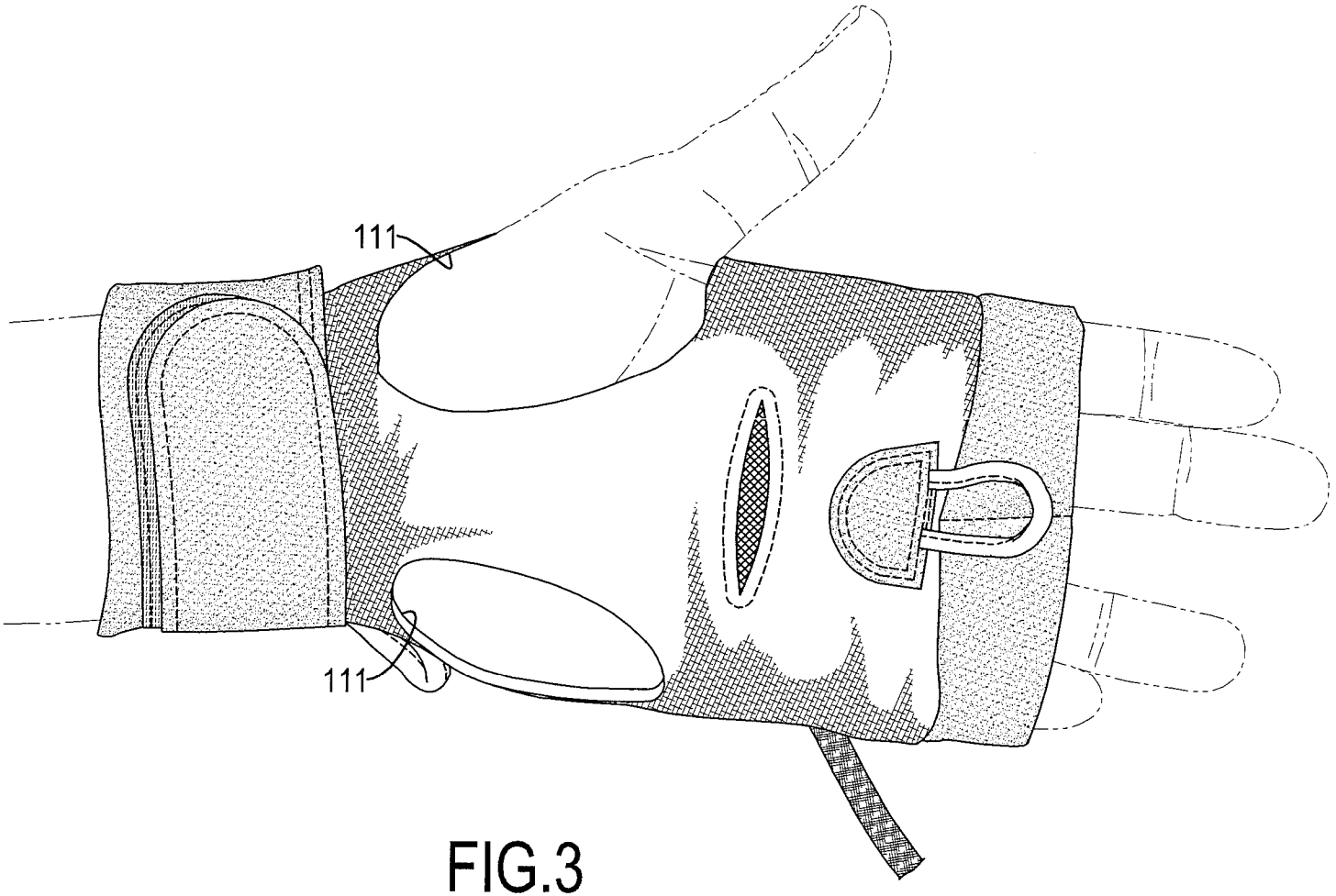
FIG. 3 is an enlarged operational bottom view of a glove of the ball-hitting glove assembly for boxing training in FIG. 1 showing that a user wears the glove on a left hand.

With reference to FIGS. 1 to 3, a first embodiment of a ball-hitting glove assembly for boxing training in accordance with the present invention comprises a glove 10, a rope 20 and a ball 30.

The glove 10 has a palm section 11, a hand back section 12 and a finger section 13. The palm section 11 has a front end. The hand back section 12 is connected securely with the palm section 11 and has a front end. The finger section 13 is connected securely with the front ends of the palm section 11 and the hand back section 12.

Preferably, the palm section 11 further has two thumb holes 111 formed through the palm section 11 and respectively near a right side and a left side of the palm section 11. With the thumb holes 111, a user is allowed to wear the glove 10 on a right hand or a left hand; the glove 10 is not exclusive for a right hand or a left hand. Accordingly, the user does not have to purchase an additional ball-hitting glove assembly for boxing training, a purchasing cost is saved and one ball-hitting glove assembly for boxing training can be carried conveniently.

Figure 5:
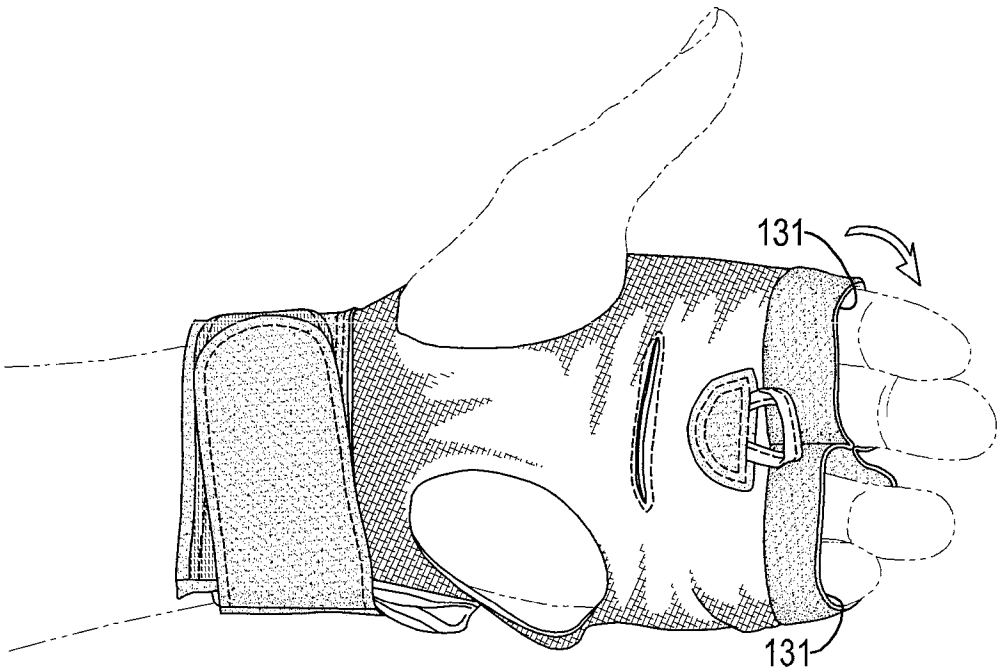
FIG. 5 is an operational bottom view of the ball-hitting glove assembly for boxing training in FIG. 3 showing that the palm hole is closed.

With further reference to FIG. 5, the finger section 13 has two finger holes 131 formed in a front side of the finger section 13. A size of an opening of one of the finger holes 131 is approximately the same as that of an opening of the other of the finger holes 131. The opening of each finger hole 131 can encompass two fingers, such as an index finger and a middle finger or a ring finger and a little finger. With the finger holes 131, the glove 10 also allows a user to wear the glove 10 on a right hand or a left hand.

With reference to FIGS. 1 and 2, the rope 20 is elastic and is connected securely to the glove 10 and has a glove end 21 and a ball end 22. The glove end 21 is mounted securely on the hand back section 12. A ball-hitting area is approximately located at the finger section 13 and is located at an area where the finger section 13 is connected with the hand back section 12. Because the glove end 21 is mounted on the hand back section 12, the ball 30 can avoid hitting the glove end 21.

Accordingly, an irregular bounce of the ball 30 is prevented and a user can continue to hit the ball 30.

Preferably, the hand back section 12 further has a connecting pad 121. The connecting pad 121 is located at the top surface of the hand back section 12 and has a top surface and a pad opening 1211. The pad opening 1211 is formed on the top surface of the connecting pad 121. The glove end 21 of the rope 20 is securely mounted through the connecting pad 121 and has a knot section 211. The knot section 211 radially protrudes out from the pad opening 1211 of the connecting pad 121. The rope 20 is easily pulled to fall off from the glove 10 when the ball 30 is hit by the glove 10. With the protruding knot section 211 restricted by the pad opening 1211, the connection between the rope 20 and the glove 10 is strengthened and the knot section 211 does not easily fall off from the glove 10.

With reference to FIG. 1, the ball 30 is made of foaming material, such as PE (Polyethylene), and is mounted securely on the ball end 22 of the rope 20.

Figure 6:
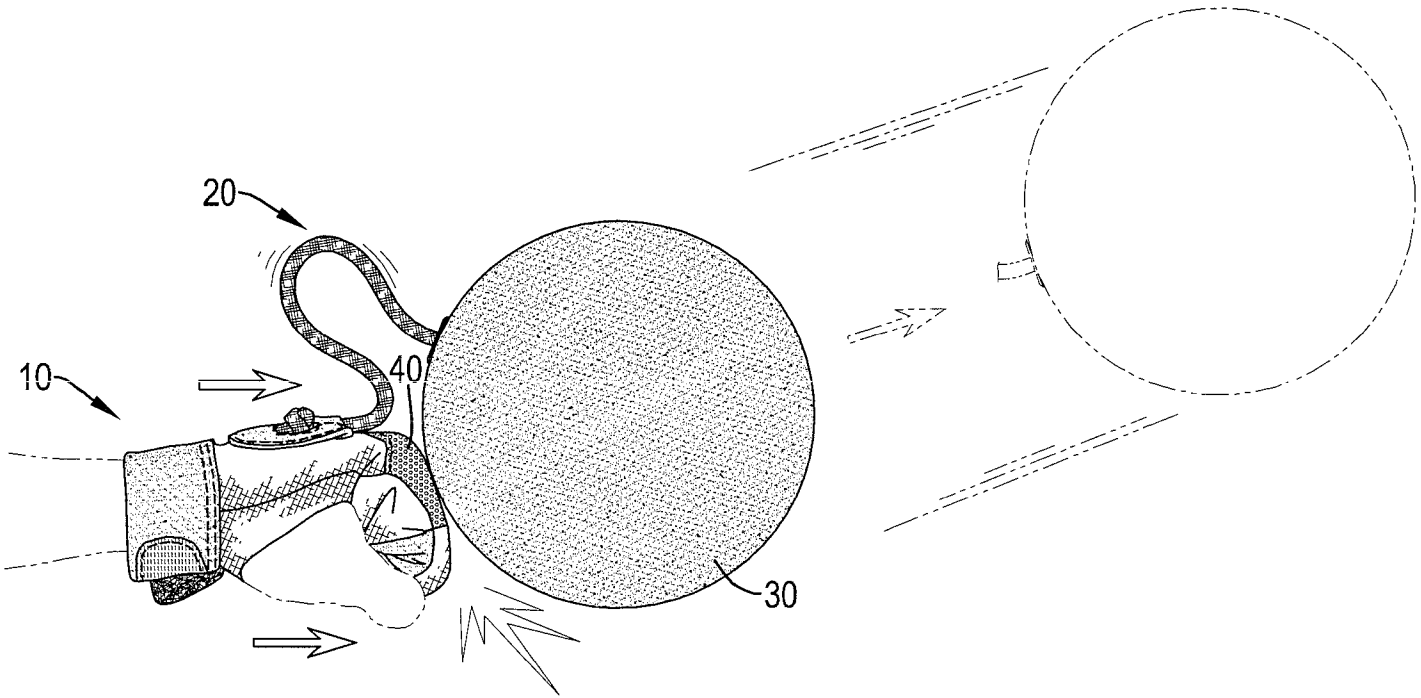
FIG. 6 is an operation view of the ball-hitting glove assembly for boxing training in FIG. 1 showing that the ball is hit.

With reference to FIGS. 1 and 6, preferably, the ball-hitting glove assembly for boxing training further has a hit pad 40. The hit pad 40 is mounted at a position where the front end of the hand back section 12 is connected with the finger section 13, is elongated and is mounted securely on a top surface of the hand back section 12 and a top surface of the finger section 13.

The ball-hitting area, such as the position where the front end of the hand back section 12 is connected with the finger section 13, may wear after repeated ball-hitting. With the hit pad 40 mounted on the position where the front end of the hand back section 12 is connected with the finger section 13, the hit pad 40 can prevent the glove 10 from wearing out.

Figure 4:
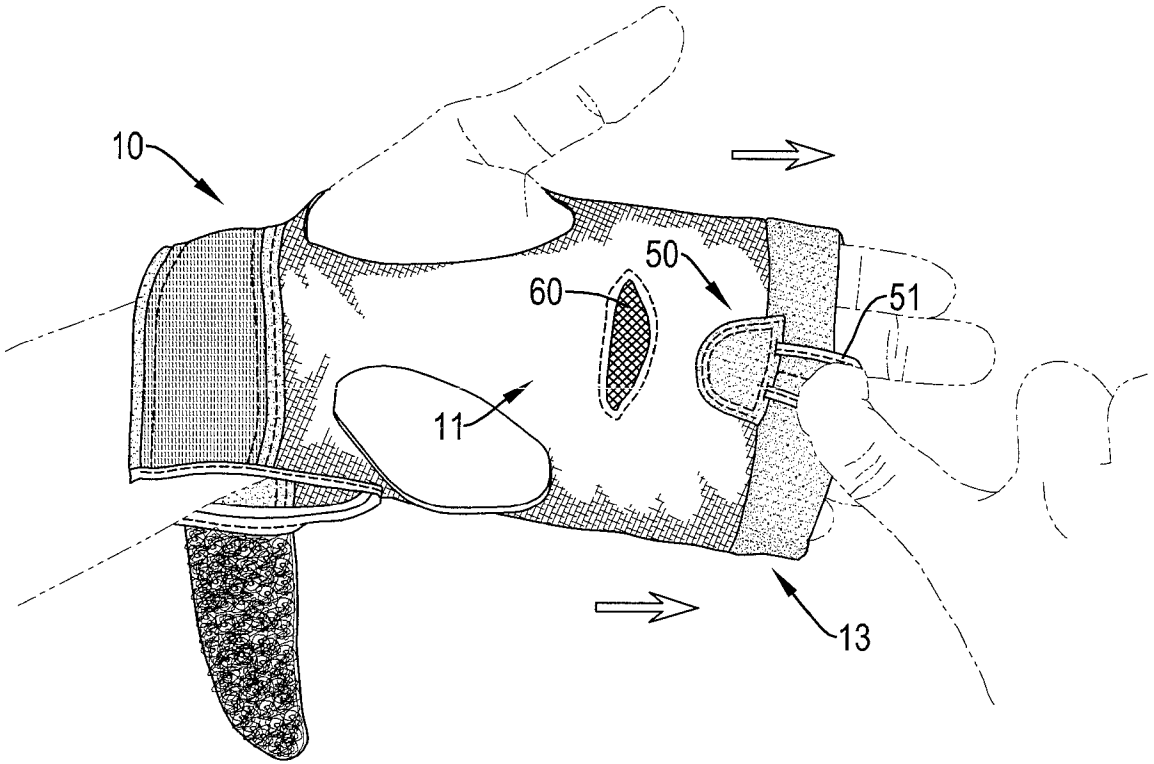
FIG. 4 is an operational bottom view of the ball-hitting glove assembly for boxing training in FIG. 3 showing that the glove is taken off by one finger.

With reference to FIGS. 2 and 4, the ball-hitting glove assembly for boxing training further has a strip 50. The strip 50 is located outside and mounted securely on the glove 10, is located near a position where the front end of the palm section 11 is connected with the front end of the finger section 13 and has two opposite ends and a central segment 51. The ends of the strip 50 are respectively and securely mounted on the glove 10. The central segment 51 of the strip 50 is arcuate, is located between the ends of the strip 50 and is close to the finger section 13 relative to the ends of the strip 50. The strip 50 allows a user to take off the glove 10 with one finger and this is very convenient.

With reference to FIGS. 2 and 5, the palm section 11 further has an eye-shaped contractible palm hole 112 formed through the palm section 11, located between the strip 50 and the thumb holes 111 and capable of being opened or closed.

The ball-hitting glove assembly for boxing training further has a net lining 60 mounted in the glove 10, securely mounted on the palm section 11 and located at the palm hole 112.

When the fingers are curled in toward the palm, the palm hole 112 is contracted and closed to reduce a wrinkle originally generated on the palm section 11. Accordingly, the glove 10 can touch the hand closely and is ergonomic. The net lining 60 can prevent foreign objects from entering the glove 10 via the palm hole 112.

Figure 7:
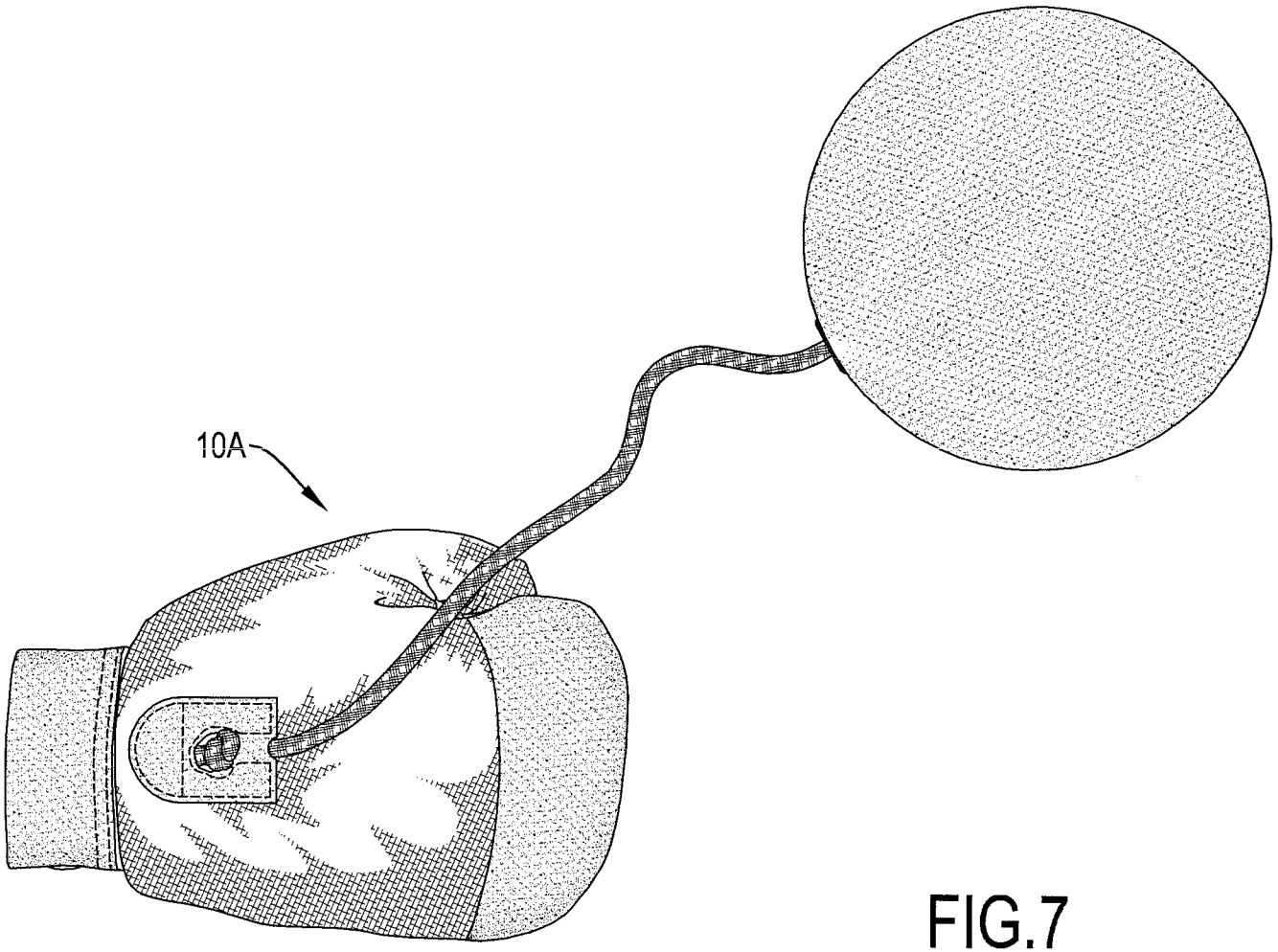
FIG. 7 is a top view of a second embodiment of the ball-hitting glove assembly in accordance with the present invention.
Figure 8:
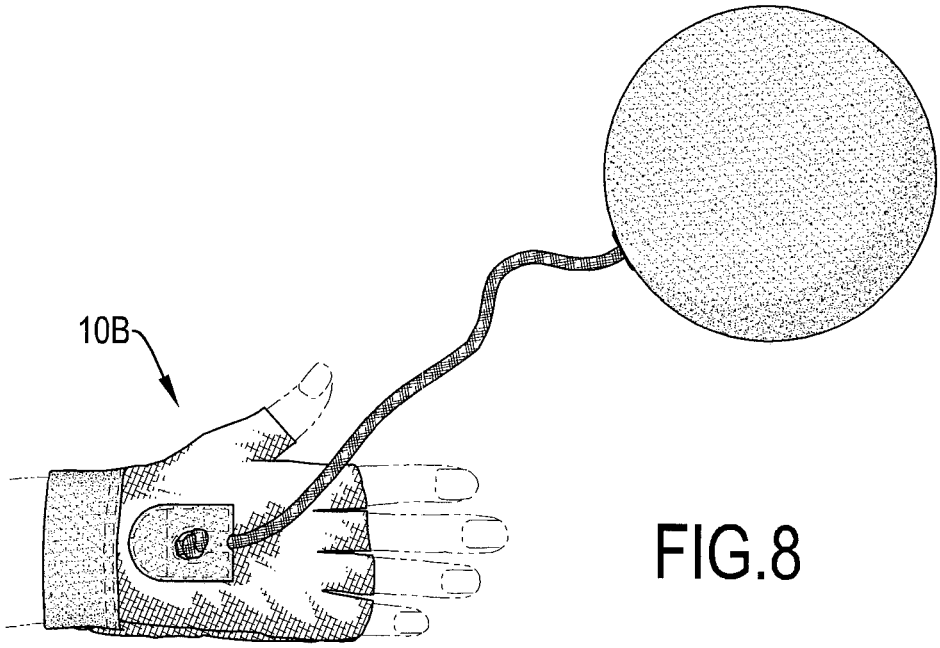
FIG. 8 is a top view of a third embodiment of the ball-hitting glove assembly in accordance with the present invention.
Figure 9:
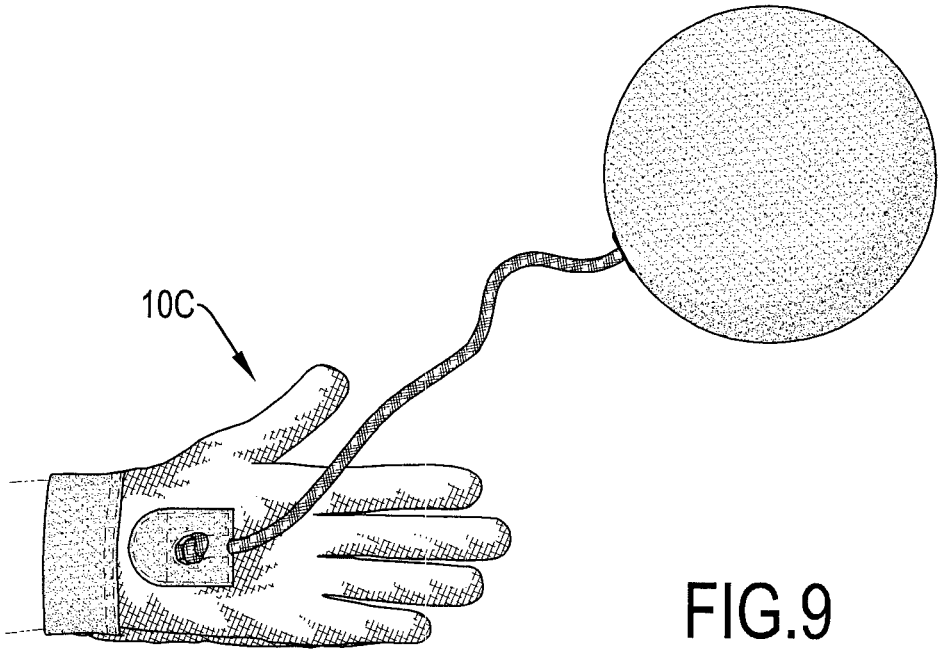
FIG. 9 is a top view of a fourth embodiment of the ball-hitting glove assembly in accordance with the present invention.
Figure 10:
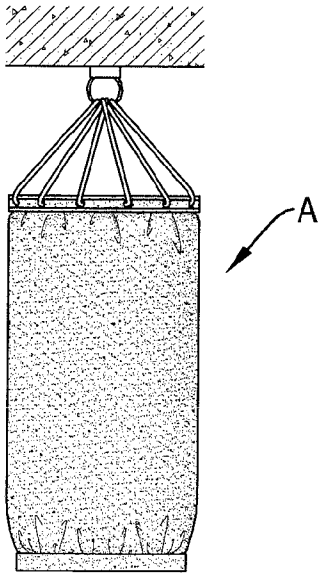
FIG.10 PRIOR ART
FIG. 10 is a side view of a conventional boxing sandbag in accordance with the prior art.
Figure 11:
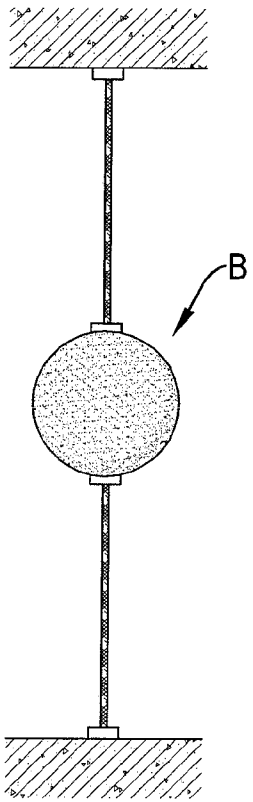
FIG.11 PRIOR ART
FIG. 11 is a side view of a conventional first training ball for boxing in accordance with the prior art.
Figure 12:
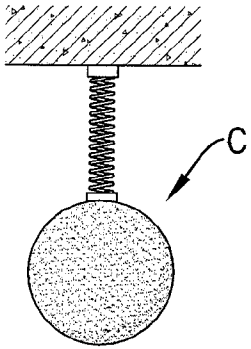
FIG.12 PRIOR ART
FIG. 12 is a side view of a conventional second training ball for boxing in accordance with the prior art.
Figure 13:
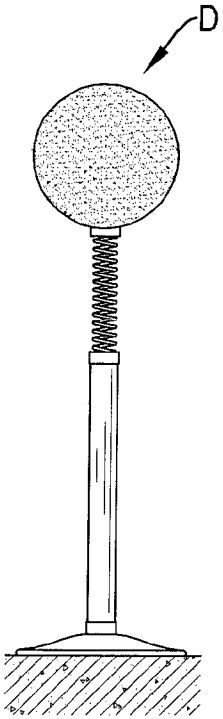
FIG.13 PRIOR ART
FIG. 13 is a side view of a conventional third training ball for boxing in accordance with the prior art.

With reference to FIG. 7, a second embodiment of the ball-hitting glove assembly for boxing training is substantially the same as the first embodiment except the glove 10A is a boxing glove. With reference to FIG. 8, a glove 10B of a third embodiment of the ball-hitting glove assembly for boxing training is a half-finger glove. With reference to FIG. 9, a glove 10C of a fourth embodiment of the ball-hitting glove assembly for boxing training is a full-finger glove. The present invention does not limit the format of the glove 10,10A,10B,10C.

From the above description, it is noted that the present invention has the following advantages:

1. Easy carrying and any-time practice:

The ball-hitting glove assembly in accordance with the present invention is easily carried and is convenient for boxing-training at any time when a user travels or exercises outside. This is greatly practical for those who like boxing.

2. Reduced purchasing cost:

A user does not have to go to a boxing gym to rent training apparatuses every time or purchase expensive training apparatuses. Accordingly, a purchasing or rental cost is reduced.

3. Continuous ball hitting:

The glove end 21 of the rope 20 is mounted on the hand back section 12, so the ball 30 can be prevented from hitting the glove end 21 and an irregular bounce of the ball 30 is avoided. Accordingly, the ball 30 can be hit continuously.

4. Prolonged lifespan:

The hit pad 40 is mounted on the position where the ball 30 hits, the hit pad 40 can prevent the glove 10 from wearing and a lifespan of the ball-hitting glove assembly for boxing training is prolonged.

5. Use for both hands:

The thumb holes 111 allow a user to wear the glove 10 on a right hand or a left hand. Therefore, the user does not necessarily buy an additional ball-hitting glove assembly for boxing training and a purchasing cost is saved.

6. Enhanced structure:

Because the protruding knot section 211 is restricted by the pad opening 1211, the knot section 211 does not easily fall off from the glove 10 and the connection between the rope 20 and the glove 10 is secure.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ball-hitting glove assembly for boxing training comprising:

a glove having a palm section having a front end; and two thumb holes formed through the palm section and respectively near a right side and a left side of the palm section;

a hand back section connected securely with the palm section and having a front end; and a finger section connected securely with the front ends of the palm section and the hand back section;

a rope connected securely to the glove and having a glove end mounted securely on the hand back section; and a ball end opposite to the glove end of the rope;

a ball mounted securely on the ball end of the rope; and a hit pad mounted at a position where the front end of the hand back section is connected with the finger section, being elongated and mounted securely on a top surface of the hand back section and a top surface of the finger section.

2. The ball-hitting glove assembly for boxing training as claimed in claim 1, wherein the hand back section further has a connecting pad located at the top surface of the hand back section and having a top surface; and a pad opening formed on the top surface of the connecting pad; and the glove end of the rope is securely mounted through the connecting pad and has a knot section radially protruding out from the pad opening of the connecting pad.

3. The ball-hitting glove assembly for boxing training as claimed in claim 2 further comprising a strip located outside and mounted securely on the glove, located near a position where the front end of the palm section is connected with the front end of the finger section and having two opposite ends respectively and securely mounted on the glove; and an arcuate central segment located between the ends of the strip and close to the finger section relative to the ends of the strip.

4. The ball-hitting glove assembly for boxing training as claimed in claim 3, wherein the palm section has an eye-shaped contractible palm hole formed through the palm section, located between the strip and the thumb holes and capable of being opened or closed; and the ball-hitting glove assembly for boxing training further has a net lining mounted in the glove, securely mounted on the palm section and located at the palm hole.

5. The ball-hitting glove assembly for boxing training as claimed in claim 4, wherein the finger section has two finger holes formed in a front side of the finger section.

6. The ball-hitting glove assembly for boxing training as claimed in claim 1, wherein the glove is a half-finger glove.

7. The ball-hitting glove assembly for boxing training as claimed in claim 2, wherein the glove is a half-finger glove.

8. The ball-hitting glove assembly for boxing training as claimed in claim 3, wherein the glove is a half-finger glove.

9. The ball-hitting glove assembly for boxing training as claimed in claim 4, wherein the glove is a half-finger glove.

10. The ball-hitting glove assembly for boxing training as claimed in claim 5, wherein the glove is a half-finger glove.

11. The ball-hitting glove assembly for boxing training as claimed in claim 1, wherein the glove is a full-finger glove.

12. The ball-hitting glove assembly for boxing training as claimed in claim 4, wherein the glove is a full-finger glove.

13. The ball-hitting glove assembly for boxing training as claimed in claim 1, wherein the glove is a boxing glove.

14. The ball-hitting glove assembly for boxing training as claimed in claim 4, wherein the glove is a boxing glove.

* * * * *